US010633614B2

(12) United States Patent
Smith et al.

(10) Patent No.: US 10,633,614 B2
(45) Date of Patent: Apr. 28, 2020

(54) NATURAL LAUNDRY SOAPS

(71) Applicant: Vanguard Soap LLC, Memphis, TN (US)

(72) Inventors: Scott A. Smith, Memphis, TN (US); Jeffery A Breazeale, Wayzata, MN (US)

(73) Assignee: VANGUARD SOAP LLC, Memphis, TN (US)

( * ) Notice: Subject to any disclaimer, the term of this patent is extended or adjusted under 35 U.S.C. 154(b) by 0 days.

(21) Appl. No.: 15/342,112

(22) Filed: Nov. 2, 2016

(65) Prior Publication Data

US 2017/0121641 A1 May 4, 2017

Related U.S. Application Data

(60) Provisional application No. 62/249,805, filed on Nov. 2, 2015.

(51) Int. Cl.

| | |
|---|---|
| ***C11D 3/00*** | (2006.01) |
| ***C11D 3/382*** | (2006.01) |
| ***C11D 3/10*** | (2006.01) |
| ***C11D 3/386*** | (2006.01) |
| ***C11D 3/06*** | (2006.01) |
| ***C11D 3/20*** | (2006.01) |
| ***C11D 3/22*** | (2006.01) |
| ***C11D 3/04*** | (2006.01) |
| ***C11D 17/06*** | (2006.01) |
| ***C11D 17/00*** | (2006.01) |
| ***C11D 11/00*** | (2006.01) |
| ***C11D 9/00*** | (2006.01) |

(52) U.S. Cl.

CPC ..... *C11D 3/0036* (2013.01); *C11D 3/044* (2013.01); *C11D 3/06* (2013.01); *C11D 3/10* (2013.01); *C11D 3/2086* (2013.01); *C11D 3/225* (2013.01); *C11D 3/382* (2013.01); *C11D 3/386* (2013.01); *C11D 3/38627* (2013.01); *C11D 3/38636* (2013.01); *C11D 3/38645* (2013.01); *C11D 3/38654* (2013.01); *C11D 9/007* (2013.01); *C11D 11/0017* (2013.01); *C11D 17/0047* (2013.01); *C11D 17/06* (2013.01)

(58) Field of Classification Search

CPC .... C11D 3/0036; C11D 3/386; C11D 3/38627

See application file for complete search history.

(56) References Cited

U.S. PATENT DOCUMENTS

| | | | | |
|---|---|---|---|---|
| 4,642,317 | A * | 2/1987 | Palmquist | A61K 31/20 514/558 |
| 6,428,776 | B1 * | 8/2002 | Guckenbiehl | A61K 8/0229 424/401 |
| 7,638,474 | B1 * | 12/2009 | Parrish | C01B 15/01 252/186.27 |
| 9,771,549 | B2 * | 9/2017 | Agarkhed | C11D 9/18 |
| 2004/0266653 | A1 * | 12/2004 | Delplancke | C11D 3/166 510/470 |
| 2009/0220638 | A1 * | 9/2009 | Pablos Perez | C11C 1/025 426/2 |
| 2010/0056416 | A1 * | 3/2010 | Scheuing | C11D 3/225 510/284 |
| 2010/0234271 | A1 * | 9/2010 | Scheuing | C11D 1/83 510/465 |
| 2011/0143984 | A1 * | 6/2011 | Yang | C11D 3/50 510/151 |
| 2011/0250178 | A1 * | 10/2011 | Brooks | A61K 8/922 424/93.1 |
| 2012/0264662 | A1 * | 10/2012 | DiBiase | C08F 20/14 508/178 |
| 2013/0197275 | A1 * | 8/2013 | Spiegler | C11D 3/50 568/616 |
| 2017/0121641 | A1 * | 5/2017 | Smith | C11D 3/0036 |

* cited by examiner

*Primary Examiner* — Mark Eashoo
*Assistant Examiner* — M. Reza Asdjodi
(74) *Attorney, Agent, or Firm* — Butler Snow LLP

(57) ABSTRACT

A series of natural soaps, both liquid and solid, and methods of making thereof, which have a synergistic effect when formulated with anti-redeposition ingredients in laundry applications both in synthetic and natural textiles and fabrics. The fatty acids and/or natural oils based series of natural soaps include both sodium and potassium soap products that interact synergistically with, preferably, known, natural anti-redeposition agents and alkaline builders creating highly effective, natural solid (bar or powdered) and liquid laundry cleaning products. Solid forms soaps are dried to an acceptable amount of moisture content for milling. Further blending is then performed with various natural anti-redeposition agents or natural products which exhibit said characteristics and/or alkaline builders. The solid forms may be formed into single dose tablets. Effervescent additives may further be included.

1 Claim, No Drawings

NATURAL LAUNDRY SOAPS

CROSS-REFERENCES TO RELATED APPLICATIONS

This application claims benefit of priority to U.S. Provisional Application Ser. No. 62/249,805, filed Nov. 2, 2015, which is hereby incorporated by reference herein in its entirety.

FIELD OF THE INVENTION

The present invention relates to a series of natural soaps, both liquid and solid, and methods of making thereof, which have a synergistic effect when formulated with anti-redeposition ingredients in laundry applications both in synthetic and natural textiles/fabrics.

BACKGROUND OF THE INVENTION

Soap can be defined as a salt of one or more of the higher fatty acids with an alkali or metal. Most soaps are made by the action of potassium or sodium hydroxide on animal fats and vegetable oils (or fatty acids). The preparation of soap directly from the raw fatty acids by the use of a lye (either potassium or sodium hydroxide) is referred to as saponification, which is well known in the art of soap manufacture.

Cleaning compositions may be formulated to be in dry form (e.g., powder, tablet, etc.) and liquid form. Powders and liquids generally require measuring, which allows for adjusting the cleaning composition as load size changes. Cleaning compositions that contain soaps, detergents, whiteners, and/or combinations of these in a solid form, such as tablets or pucks, are known in the art (e.g., see U.S. Pat. No. 4,099,912 (Ehrlich), U.S. Pat. No. 4,642,197 (Kruse et al.), U.S. Pat. No. 4,654,341 (Nelson et al.), U.S. Pat. No. 4,897,212 (Kruse et al.), U.S. Pat. No. 5,225,100 (Fry et al.), U.S. Pat. No. 5,756,440 (Watanabe et al.), U.S. Pat. No. 5,858,959 (Surutzidis et al.), U.S. Pat. No. 6,664,226 (Jacques et al.), U.S. Pat. No. 6,689,305 (Fernholz et al.), U.S. Pat. No. 7,153,817 (Binder), U.S. Pat. No. 7,598,217 (Burg et al.), U.S. Pat. No. 8,357,647 (Sharma et al.), and U.S. Pat. No. 8,426,350 (Geret et al.), U.S. Pat. No. 8,877,240 (Moore); and U.S. Pat. App. Pub. Nos. US2003/0100101 (Huth et al.), US2003/0171245 (Goovaerts et al.), US2005/0113279 (Desmarescaux et al.), US2011/0118166 (Tjelta et al.), US2012/0142576 (Bartelme et al.), and US2013/0109609 (Smith et al.), which are hereby incorporated by reference herein in their entirety to the extent not inconsistent with the disclosure herein). Tablets or laundry pucks provide great convenience to users because they are in a form of an individual dose (i.e., no measuring is required).

Commercially offered laundry soap and detergent cleaning compositions generally have multiple synthetic components, even those marketed as "natural" soaps. Many synthetic components of commercial laundry soap and detergent cleaning compositions remain on laundered fabrics as unwanted residues that may cause irritation to skin or respiratory systems, and/or cause other unwanted issues. Homemade natural laundry soaps lack the synthetic surfactants and other components that enhance the cleaning power of commercial laundry soap and detergent cleaning compositions.

There is a need for alternative laundry soaps that are made of natural ingredients and synergistic acting additives from natural and naturally derived sources.

SUMMARY OF THE INVENTION

Accordingly, it is an object of the present invention to provide a series of novel natural solid (e.g., powdered, laundry tablet/puck, etc.) and liquid sodium and potassium soaps that interact synergistically with known anti-redeposition agents and/or alkaline builders creating highly effective, natural, solid (e.g., powdered, laundry tablet/puck, etc.) and liquid laundry cleaning soap compositions. The preferred products are tailored to optimize this synergy in laundry cleaning. The optional addition of enzymes (e.g., amylase, protease, etc.) is included in some embodiments to aid in the removal of soil and/or stains from the laundered materials. Solid forms, especially tablets and pucks, may further optionally include effervescent agents to aid in dissolution in water.

It is another object of the present invention to provide methods of making a series of novel natural solid (e.g., powdered, laundry tablet/puck, etc.) and liquid sodium and potassium soaps that interact synergistically with known anti-redeposition agents and/or alkaline builders creating highly effective, natural, solid (e.g., powdered, laundry tablet/puck, etc.) and liquid laundry cleaning soap compositions. In some embodiments, optional step of adding cleaning enzymes (e.g., amylase, protease, etc.) is included to aid in the removal of soil and/or stains from the laundered materials. Solid forms, especially tablets and pucks, may further optionally include effervescent agents to aid in dissolution in water.

DETAILED DESCRIPTION

The following detailed description is presented to enable any person skilled in the art to make and use the invention. For purposes of explanation, specific details are set forth to provide a thorough understanding of the present invention. However, it will be apparent to one skilled in the art that these specific details are not required to practice the invention. Descriptions of specific applications are provided only as representative examples. Various modifications to the preferred embodiments will be readily apparent to one skilled in the art, and the general principles defined herein may be applied to other embodiments and applications without departing from the scope of the invention. The present invention is not intended to be limited to the embodiments shown, but is to be accorded the widest possible scope consistent with the principles and features disclosed herein.

The present invention provides a series of novel natural solid (e.g., powdered, laundry tablet/puck, etc.) and liquid sodium and potassium soaps that interact synergistically with known anti-redeposition agents and/or alkaline builders creating highly effective, natural, solid (e.g., powdered, laundry tablet/puck, etc.) and liquid laundry cleaning soap compositions. The preferred soap compositions are tailored to optimize this synergy in laundry cleaning in laundry applications for both synthetic and natural textiles and fabrics. The optional addition of enzymes (e.g., amylase, protease, etc.) is included in some embodiments to aid in the removal of soil and/or stains from laundered materials. Solid forms, especially tablets and pucks, may further optionally include effervescent agents to aid in dissolution in water. However, it has been found that the disclosed soap composition formulations surprisingly perform comparably to laundry detergent products on the market that include cleaning enzymes, including laundry detergent products marketed as "natural." Thus, the addition of optional enzyme(s) to the disclosed soap composition formulations provides unexpected enhanced cleaning performance as compared to available natural and non-natural laundry detergents.

The soaps of the present invention are foaming water soluble natural soaps that are mild to the skin, have excellent color, clarity/appearance, and odor. They are particularly suited for laundry care applications; however, they can also be used in the cleaning of various types of surfaces in the home, office, and industrial settings. Both sodium and potassium soap compositions made from natural oils and fatty acids, see TABLE 1, are within the scope of the present invention.

TABLE 1

| Example | Fatty Acid and or Oil Name | Carbon Chain |
|---|---|---|
| 1 | Butyric/Caproic | C4/C6 |
| 2 | Caprylic | C8 |
| 3 | Capric | C10 |
| 4 | Caprylic/Capric | C8/C10 |
| 5 | Lauric | C12 |
| 6 | Myristic | C14 |
| 7 | Lauric/Myristic | C12/C14 |
| 8 | Palmitic | C16 |
| 9 | Stearic | C18 |
| 10 | Oleic | C18:1 |
| 11 | Ricinoleic | C18:1(OH) |
| 12 | Behenic/Eurucic | C22/C22:1 |
| 13 | Coconut Oil | Whole Oil Distribution |
| 14 | Olive Oil | Whole Oil Distribution |
| 15 | Tall Oil Fatty Acid | Whole Oil Distribution |
| 16 | Palm Oil | Whole Oil Distribution |

It is another object of the present invention to provide methods of making a series of novel natural solid (e.g., powdered, laundry tablet/puck, etc.) and liquid sodium and potassium soaps that interact synergistically with known anti-redeposition agents and/or alkaline builders creating highly effective, natural, solid (e.g., powdered, laundry tablet/puck, etc.) and liquid laundry cleaning soap compositions. In some embodiments, optional step of adding cleaning enzymes (e.g., amylase, protease, etc.) is included to aid in the removal of soil and/or stains from the laundered materials. Solid forms, especially tablets and pucks, may further optionally include effervescent agents to aid in dissolution in water.

The preferred solid form is a laundry tablet or puck, which may further optionally comprise an effervescent additive composition. Effervescency, as defined herein, means the evolution of bubbles of gas from a liquid, as the result of a chemical reaction between a soluble acid source and an alkali metal carbonate, to produce carbon dioxide gas. An effervescent composition may be added to the tablet mixture in addition to the natural soap composition. The addition of this effervescent composition to the tablet improves the disintegration time of the tablet in water. Preferably the effervescent composition should be added as an agglomerate of the different ingredient particles or as a compact, and not as separated particles. An effervescent composition typically presents in a laundry tablet at a level of from 5% to 20%, or from 10% to 15% by weight of the laundry tablet. Here, the effervescent compositions of the present invention may range from about 1% to about 50%, preferably from about 1% to about 60%, more preferably from about 1% to about 75%, and most preferably from about 1% to about 85%. The acid source for the effervescent additive composition may be any acid source, but preferably is comprised of an acid source that is dissolvable in water. Preferred acid sources include citric acid, ascorbic acid, and tartaric acid. The acid source(s) may overlap with acidic anti-redeposition agents in the cleaning compositions. The alkali metal carbonate is preferably a sodium carbonate and sodium bicarbonate, but other carbonates, especially potassium metal carbonates may be used. The effervescent compositions of the present invention may further include pH adjusting agents, preservatives, and/or other adjuncts.

To prepare the soaps of the compositions, a given amount of fatty acid and/or natural oils are added to a reaction container equipped with agitation, heat, thermometer, and nitrogen blanket (when necessary—for example, nitrogen sparge and blanket can be used to prevent darkening of the color of the resulting soaps during the process). Next, the specified number of grams of lye reactant (i.e., potassium hydroxide and/or sodium hydroxide) is added under good agitation, optionally with a nitrogen blank. The amount of lye added to the reaction is directly dependent on the amount of fatty acid and/or natural oils added. Next is added enough water to seed the reaction and help it to proceed efficiently.

Nitrogen blank, when utilized, is simply low cfm (cubic feet per minute) nitrogen flow into the reaction vessel to displace air. Thus, a nitrogen blanket of the reacting product with inert gas minimizes the oxidative exposure of the batch and helps to maintain a low color. The reaction mass is heated to 90-105° C. and is held for 2-5 hours.

Testing for the percent free alkali follows the reaction progress. Once the theoretical value is reached, the reaction is terminated. When the reaction is terminated, the product may be processed further without additional purification. When the reaction is terminated in the case of products which are intended to be solids at room temperature, the batch is then processed through a drying line to lower the percent moisture to acceptable levels for milling into dry forms. Along with each example (see TABLE 1), multiple blends were assembled between different example fatty acid and oil bases to achieve optimization for detergency and different physical attributes. For the purpose of liquid examples, hydrochloric acid and/or citric acid were utilized as neutralizing agents; however, those skilled in the art may use other neutralizing agents without departing from the spirit and scope of the invention. The amount of neutralizing (pH adjusting) agent will vary as needed, but may range from 0.01% to 20.0% by weight when used. For the purpose of the solid examples samples, the batches were dried to an average of 5% moisture content and finished in flakes, granules, or powders. These solid forms can then be processed to form single dose-sized laundry tablets and pucks by any method known in the art, for example by extrusion or by pressing.

Further blending is necessary with various natural anti-redeposition agents or natural products which exhibit anti-redeposition characteristics and/or alkaline builders. These adjuvants are well-known in the field, and may be used herein in the range of 0.1% to 30% by total weight. The examples listed below in TABLE 2 and various blends of each of the examples were utilized to create optimized products. Those skilled in the art may use other anti-redeposition agents and alkaline builders, both natural and synthetic, without departing from the spirit and scope of the invention.

TABLE 2

| Anti-Redeposition Additives | Alkaline Builders |
|---|---|
| Gluconic Acid | Sodium Carbonate |
| Sodium Gluconate | Sodium Bi-Carbonate |
| Tartaric Acid | Trisodium Pyrophosphate |

TABLE 2-continued

| Anti-Redeposition Additives | Alkaline Builders |
|---|---|
| Sodium Tartarate<br>Carboxymethyl Cellulose | Tripotassium Pyrophospate |

In some embodiments, an optional step of adding cleaning-aid enzymes (e.g., amylases, oxidases, pectinases, mannanases, cellulases, proteases, lipases, and the like known in the field—with or without enzyme stabilizers well known in the art) is included to aid in the removal of soil and/or stains from the laundered materials. On a weight percentage basis of the active ingredients in the composition, it is preferable that the enzyme composition range from about 0.01% to about 5% by weight of the % solids weight in the natural soaps cleaning compositions. However, any amount that is sufficient to work effectively as intended to fight stains and soil on fabrics. These amounts, thus, are based on the enzyme activity corrected to 100%. A person of skill in the art is capable of determining the optimum amount by routine laboratory methods.

Other adjuncts may be included, with a strong preference for natural or naturally sourced agents, such as binders, suds suppressors, soil suspending agents, soil release agents, other fabric care benefit agents, pH adjusting agents, chelating agents, hydrotropes and phase stabilizers, structuring agents, dye transfer inhibiting agents, optical brighteners, perfumes (fragrances), and coloring agents. The various optional adjunct ingredients, if present in the natural soap cleaning compositions herein, should be utilized at concentrations conventionally employed to bring about their desired contribution to the composition or the laundering methods. Frequently, the total amount of such optional adjunct ingredients can range from about 0.01% to about 90%, or from about 1% to about 70%, or from about 10% to about 30% by weight of the total composition.

Example 1

Comparison of Powdered and Liquid Natural Laundry Soap Formulations with Commercially Available "Natural" Laundry Detergents—TABLE 3 provides results of a comparison test between exemplary embodiments of a non-enzyme, natural laundry soap formulations (both liquid and powdered) and a leading "natural" laundry detergent brand product that includes enzymes that is commercially available in a liquid and a powdered form. The data in TABLE 3 comparison tests was derived according to the ASTM D4265-98 (reapproved 2007) Standard Guide for Evaluating Stain Removal Performance in Home Laundering (modified) and ASTM E 97 Standard Method for Directional Reflectance Factor, 45-deg 0-deg, of Opaque Specimens by Broad band Filter Reflectometry. The testing methods employed here are discussed in more detail below and were performed by an independent, third-party contracting laboratory. Surprisingly, the liquid formulation of the non-enzyme, natural laundry soap was comparable for most test substrate categories as the commercial "natural" liquid detergent with enzymes to aid in cleaning. The only two test substrates in which the commercial "natural" liquid detergent with enzymes noticeably out-performed the liquid non-enzyme, natural laundry soap formulation was "Blood/Milk/Carbon EMPA 116 (cotton)" and "Dust Sebum (cotton)." Even more unexpected was the nearly identical total Delta-E and individual test substrate category results in the comparison between the powdered formulation of the non-enzyme, natural laundry soap and the commercial "natural" powdered detergent with enzymes to aid in cleaning. Here, the powdered formulation of the non-enzyme, natural laundry soap out-performed the commercial product with enzyme in the Red Wine EMPA 114 stain on cotton swatch. These results demonstrate that the natural laundry soaps made of natural ingredients and synergistic acting additives from natural and naturally derived sources (even without the aid of cleaning enzymes) unexpectedly perform comparably or better than leading commercial brands that include enzymes to reach their level of cleaning power. Other results, not shown, between the natural laundry soap formulations with enzyme and the commercial "natural" detergents with enzyme show an unexpected superior performance.

The tested samples were 100% Biodegradable Premium HE Liquid Laundry Natural Soap LC #15-T0634 (Lot #16740) and 100% Biodegradable Premium HE Powder Laundry Natural Soap LC #15-T0635 (Lot #150820) according to the present invention. The makeup of these sample compositions are essentially the same as the formulas provided below in TABLE 4 without the added enzyme cocktail. The commercial products tested were SEVENTH GENERATION Natural Laundry Detergent Liquid LC #15-T0636 (UPC #3291322785; Lot # AA14335 C1143451) and SEVENTH GENERATION Natural Laundry Detergent Powder LC #15-T0667 (UPC #3291322824; Lot #5097B).

The procedure was as follows: Artificially soiled fabrics were acquired from Test Fabrics Inc. The fabrics were selected to evaluate a good cross section of polar and non-polar soils and stains. The "L, a, b, and y" value for each stained fabric type was determined with a Hunter colorimeter 45/0 using a UV filter, prior to cleaning. Three swatches for every soil were used for each detergent sample.

The following soils were used in each of the laundry tests (swatch material fabric type): Grass Stain PCS-8 (cotton-poly); Coffee (cotton-poly); EMPA112 Cocoa (cotton); EMPA116 Blood, Milk, Carbon (cotton); Blood (cotton); EMPA114 Red Wine (cotton); Tomato Beef Sauce (cotton); and Dust Sebum (cotton).

The swatches were then laundered using a WHIRLPOOL DUET front load h-e washer model with settings as "regular," "medium load," warm wash with cold rinse for each product," and WHIRLPOOL DUET h-e dryer model. Eight (8) ballast (4 cotton, 4 poly-cotton) sheets Test Fabrics Inc. were used in each test load.

"L, a, b, and Y" values of cleaned fabric swatches were measured using a colorimeter with a UV filter. Each of the swatches for each stain were measured twice and then stacked on top of each other during measurement, (as per recommendations from Hunter Lab outlined in bulletin, "Measuring Fabric Using the Lab Scan"). The first measurement was taken and then the swatch was turned 90° and the second measurement was taken. The 4 measurements were averaged and recorded. The L, a, b values are then used to calculate the delta E, which is a change in color of the stained fabric.

$$\sqrt{(L_1-L_2)^2+(a_1-a_2)^2+(b_1-b_2)^2}$$

$L_1$—initial L value $L_2$—final L value $a_1$—initial a value $a_2$—final a value $b_1$—initial b value $b_2$—final b value

TABLE 3

| Average Delta-E Values | | | | |
|---|---|---|---|---|
| Stain | Premium HE Liquid LC#15-T0634 Dosage: 44.5 mL | 7TH GEN Liquid LC#15-T0636 Dosage: 44.5 mL | Premium HE Powder LC#15-T0635 Dosage: 45.3 gm | 7TH GEN Powder LC#15-T0667 Dosage: 45.3 gm |
| Grass Stain (poly-cotton) | 2.99 | 5.18 | 8.24 | 8.86 |
| Coffee (poly-cotton) | 1.55 | 1.53 | 2.02 | 2.51 |
| Cocoa EMPA 112 (cotton) | 6.53 | 10.71 | 13.55 | 13.26 |
| Blood/Milk/Carbon EMPA 116 (cotton) | 11.02 | 18.29 | 18.94 | 20.57 |
| Blood (cotton) | 22.10 | 22.83 | 39.96 | 41.84 |
| Red Wine EMPA 114 (cotton) | 11.57 | 13.01 | 12.02 | 8.33 |
| Tomato/Beef Sauce (cotton) | 12.57 | 13.92 | 15.02 | 15.11 |
| Dust Sebum (cotton) | 2.75 | 8.14 | 7.95 | 8.62 |
| Delta E total: | 71.08 | 93.61 | 117.69 | 119.11 |

Delta-E is used to describe (mathematically) the distance between two colors (i.e., the color of unlaundered fabric and the color after laundering of the fabric). To calculate the Delta-E of any two colors, you need to know their L,a,b values. The average, casual viewer can notice the difference between two colors that are 5-6 Delta-E apart. A trained eye is capable of differentiating two colors that are closer to 3-4 Delta-E apart.

Example 2

The inventive compositions of Example 1 (100% Biodegradable Premium HE Liquid Laundry Natural Soap LC #15-T0634 and 100% Biodegradable Premium HE Powder Laundry Natural Soap LC #15-T0635) were reformulated with the addition of a cocktail of stain fighting enzymes (MEDLEY Brilliant from Novozymes). The formulation makeups of the synergistic liquid and solid natural soap and anti-redeposition cleaning compositions above with added enzyme (100% Biodegradable Premium HE Liquid Laundry Natural Soap LC #15-T0804 and 100% Biodegradable Premium HE Powder Laundry Natural Soap LC #16-T0168 Lot #17171, respectively) are shown below in TABLE 4.

TABLE 4

| Raw Material | Wt % |
|---|---|
| Liquid Laundry Enzyme LC#15-T0804 | |
| Valpro 430 | 95.07 |
| Sodium Bicarbonate | 0.11 |
| Sodium Gluconate | 0.45 |
| Medley Brilliant Enzyme | 1.5 |
| NaCl(25%) | 2.87 |
| Liquid Sample Soap (Valpro 430) | |
| COCONUT OIL | 14.40 |
| Oleic Fatty Acid | 9.60 |
| Olive Oil | 1.92 |
| Potassium Hydroxide (25%) | 26.64 |
| City Water | 36.74 |
| Potassium HydroxideH (45%) | 4.18 |
| Citric Acid (50%) | 6.52 |

TABLE 4-continued

| Raw Material | Wt % |
|---|---|
| Powder Laundry Enzyme LC#16-T0168 | |
| Valpro PRL-98 | 96 |
| Sodium Gluconate | 1.5 |
| Sodium Carbonate | 1 |
| Medley Enzyme | 1.5 |
| Solid Sample Soap (Valpro PRL-98) | |
| Coconut Oil | 70 |
| Sodium Hydroxide 50% | 30 |

The same test battery of Example 1 was conducted for the enzyme-containing reformulations to find Delta-E. The Delta-E total was surprisingly found to be greatly improved in both the liquid and solid samples (LC #15-T0804 and LC #16-T0168, respectively). See TABLE 5, below. The Delta-E total for LC #15-T0804 improved from 71.08 to 95.89 to be better than the commercial liquid laundry detergent marketed as "natural" with enzymes included. The Delta-E total for LC #16-T0168 improved from 117.69 to 145.90 to be much better than the commercial powdered laundry detergent marketed as "natural" with enzymes included.

Additionally four other commercially marketed laundry detergents were tested: TIDE HE Laundry Detergent, METHOD Laundry Detergent, Mrs. Meyer's Laundry Detergent, and WHOLE FOODS Laundry Detergent. Delta-E totals for these were found to be 102.94, 90.06, 87.27, and 65.77, respectively.

TABLE 5

| Stain | Premium HE Liquid LC#15-T0634 Dosage: 44.5 mL | Premium HE Powder LC#15-T0635 Dosage: 45.3 gm |
|---|---|---|
| Grass Stain (poly-cotton) | 4.81 | 10.54 |
| Coffee (poly-cotton) | 1.49 | 2.67 |
| Cocoa EMPA 112 (cotton) | 11.53 | 15.35 |

TABLE 5-continued

| Stain | Premium HE Liquid LC#15-T0634 Dosage: 44.5 mL | Premium HE Powder LC#15-T0635 Dosage: 45.3 gm |
|---|---|---|
| Blood/Milk/Carbon EMPA 116 (cotton) | 21.24 | 32.66 |
| Blood (cotton) | 23.91 | 44.43 |
| Red Wine EMPA 114 (cotton) | 12.61 | 12.71 |
| Tomato/Beef Sauce (cotton) | 13.93 | 15.14 |
| Dust Sebum (cotton) | 6.37 | 12.40 |
| Delta E total: | 95.89 | 145.90 |

Example 3

Tested Example Formulations of Laundry Soap Tablet/Puck with Natural Soaps. TABLE 6 provides example formulations with natural soaps formed into laundry tablets/pucks by extrusion and by pressing. The fatty acid and sodium hydroxide raw materials included in the formulations generally add up to about 99% by weight of the total formulation weight within TABLE 6; however, all weight %'s for these raw ingredients are approximate due to natural inconsistencies in the feedstocks of the fatty acids/oils and these listed raw material ingredients are adjusted to add up to a total of 100% by weight of the total formulation weight. For example, sodium hydroxide is listed for each sample formulation as 24% by weight, but it should be understood that this is only an average. The actual amount of sodium hydroxide required will be determined on an ad hoc basis with each batch by moving up or down to compensate for the above mentioned feedstock inconsistencies and the saponification value of the feedstocks in relationship to the % Free Alkalinity necessary for the finished product after the reaction and drying process is complete (usually about 0.02% to about 1.00%). Also, the sodium hydroxide "lye" can be replaced entirely or partially with potassium hydroxide. I have found that the introduction of potassium hydroxide in these formulations makes the soaps softer, thus improving the dissolution properties of the soaps in water.

Water and citric acid as raw materials are listed throughout as "Q.S.," which means the quantity sufficient to reach a desired end point. Water is initially added to the reaction to help seed it. Both water and citric acid are added to the reaction to adjust the final pH by buffering as needed. In some cases, citrate will not be added to the reaction or the completed reaction. However, excess alkalinity is necessary to drive the saponification reaction to completion, and, depending on the feedstock used, this free alkalinity is at appoint upon completion of the reaction that it must be adjusted down with citric acid. The pH of the formulation samples ranges from about 8.8 to about 13.5. I have found that the preferred pH range is between about 9.5 and about 10.5 for these sample formulations. Water is dried out of the completed reaction to achieve varying levels of % solids in the total reaction batch. The finished good % weight of water may range from about 1% to about 22%, preferably from about 1% to about 15%, and more preferably 12% or less. The finished good % solids, therefore, may range from about 78% to about 99%, preferably from about 85% to about 99%, more preferably 88% or more.

TABLE 6

| Sample | Raw Material: | Wt %: |
|---|---|---|
| 1) | Butyric Fatty Acid | 63 to 65 |
| | Caproic Fatty Acid | 10 to 12 |
| | Sodium Hydroxide | 24 |
| | Water | Q.S. |
| | Citric Acid | Q.S. |
| 2) | Caprylic and or Capric Fatty Acid | 75 |
| | Sodium Hydroxide | 24 |
| | Water | Q.S. |
| | Citric Acid | Q.S. |
| 3) | Caprylic Fatty Acid | 60 to 68 |
| | Capric Fatty Acid | 7 to 15 |
| | Sodium Hydroxide | 24 |
| | Water | Q.S. |
| | Citric Acid | Q.S. |
| 4) | Lauric Fatty Acid | 75 |
| | Sodium Hydroxide | 24 |
| | Water | Q.S. |
| | Citric Acid | Q.S. |
| 5) | Lauric Fatty Acid | 70 |
| | Myristic Fatty Acid | 5 |
| | Sodium Hydroxide | 24 |
| | Water | Q.S. |
| | Citric Acid | Q.S. |
| 6) | Myristic Fatty Acid | 75 |
| | Sodium Hydroxide | 24 |
| | Water | Q.S. |
| | Citric Acid | Q.S. |
| 7) | Palmitic Fatty Acid | 75 |
| | Sodium Hydroxide | 24 |
| | Water | Q.S. |
| | Citric Acid | Q.S. |
| 8) | Palmitic Fatty Acid | 60 |
| | Stearic Fatty Acid | 15 |
| | Sodium Hydroxide | 24 |
| | Water | Q.S. |
| | Citric Acid | Q.S. |
| 9) | Oleic Fatty Acid | 60 |
| | Stearic Fatty Acid | 15 |
| | Sodium Hydroxide | 24 |
| | Water | Q.S. |
| | Citric Acid | Q.S. |
| 10) | Oleic Fatty Acid | 60 |
| | Olive Oil | 15 |
| | Sodium Hydroxide | 24 |
| | Water | Q.S. |
| | Citric Acid | Q.S. |
| 11) | Coconut Oil and or Palm Kernel Oil | 60 |
| | Oleic Fatty Acid | 10 |
| | Olive Oil | 5 |
| | Sodium Hydroxide | 24 |
| | Water | Q.S. |
| | Citric Acid | Q.S. |
| 12) | Myristic Fatty Acid | 20 |
| | Coconut Oil and or Palm Kernel Oil | 55 |
| | Sodium Hydroxide | 24 |
| | Water | Q.S. |
| | Citric Acid | Q.S. |
| 13) | Coconut Oil and or Palm Kernel Oil | 60 |
| | Ricinoleic Fatty Acid | 14 |
| | Sodium Hydroxide | 24 |
| | Water | Q.S. |
| | Citric Acid | Q.S. |
| 14) | Coconut Oil and or Palm Kernel Oil | 60 |
| | Ricinoleic Fatty Acid | 10 |
| | Behenic/Eurucic | 5 |
| | Sodium Hydroxide | 24 |
| | Water | Q.S. |
| | Citric Acid | Q.S. |
| 15) | Coconut Oil and or Palm Kernel Oil | 65 |
| | Olive Oil | 10 |
| | Sodium Hydroxide | 24 |
| | Water | Q.S. |
| | Citric Acid | Q.S. |
| 16) | Coconut Oil and or Palm Kernel Oil | 65 |
| | Tall Oil Fatty Acid | 10 |
| | Sodium Hydroxide | 24 |
| | Water | Q.S. |
| | Citric Acid | Q.S. |

TABLE 6-continued

| Sample | Raw Material: | Wt %: |
|---|---|---|
| 17) | Coconut Oil and or Palm Kernel Oil | 10 |
| | Tallow | 65 |
| | Sodium Hydroxide | 24 |
| | Water | Q.S. |
| | Citric Acid | Q.S. |
| 18) | Coconut Oil and or Palm Kernel Oil | 10 |
| | Tallow and or Palm | 65 |
| | Sodium Hydroxide | 24 |
| | Water | Q.S. |
| | Citric Acid | Q.S. |
| 19) | Coconut Oil and or Palm Kernel Oil | 75 |
| | Sodium Hydroxide | 24 |
| | Water | Q.S. |
| | Citric Acid | Q.S. |
| 20) | Sunflower Oil | 60 |
| | Coconut Oil and or Palm Kernel Oil | 15 |
| | Sodium Hydroxide | 24 |
| | Water | Q.S. |
| | Citric Acid | Q.S. |
| 21) | Safflower Oil | 15 |
| | Coconut Oil and or Palm Kernel Oil | 60 |
| | Sodium Hydroxide | 24 |
| | Water | Q.S. |
| | Citric Acid | Q.S. |
| 22) | Sunflower Oil | 10 |
| | Coconut Oil and or Palm Kernel Oil | 60 |
| | Olive Oil | 5 |
| | Sodium Hydroxide | 24 |
| | Water | Q.S. |
| | Citric Acid | Q.S. |
| 23) | Safflower Oil | 60 |
| | Coconut Oil and or Palm Kernel Oil | 10 |
| | Olive Oil | 5 |
| | Sodium Hydroxide | 24 |
| | Water | Q.S. |
| | Citric Acid | Q.S. |

Where employed, the anti-redeposition additives and/or the builders listed in TABLE 2 and discussed above, as well as binders, enzymes, enzyme stabilizers, water softeners, and fragrances (all preferably natural or naturally sourced) are in addition to the % weights listed above in TABLE 6. It should be noted that all of the natural soaps compositions bind quite well and maintain a tablet form without added binders, which was unexpected. However, binders may be used with these natural soap cleaning compositions.

Example 4

Tested Example Formulations of Effervescent Laundry Soap Tablet/Puck with Natural Soaps. TABLE 7 provides example formulations of effervescent additive compositions that were combined with the natural soaps compositions listed in TABLE 6 and formed into laundry tablets/pucks by extrusion and by pressing. The effervescent additive compositions were combined with the natural soaps compositions listed in TABLE 6 in ratios ranging from 1:1 (effervescent additive composition to natural soap composition) to 1:99 (effervescent additive composition to natural soap composition) prior to being pressed or extruded into tablets. Greater than 50% soap composition is preferred. These samples continued to show excellent cleaning power that is greater than expected for natural soap formulations, as demonstrated in Example 1.

The weight percent of the following examples comprise the entire formulation up to 100% weight of the total effervescent additive composition. Any further anti-redeposition additives and/or the builders listed in TABLE 2 and discussed above, as well as binders, enzymes, enzyme stabilizers, water softeners, and fragrances (all preferably natural or naturally sourced) are in addition to the % weights listed above in TABLE 7. It should be noted that all combined effervescent additive compositions and natural soaps compositions bind quite well and maintain a tablet form without added binders, which was unexpected. However, binders may be used with these combined natural soap cleaning compositions.

TABLE 7

| Sample | Raw Material: | Wt %: |
|---|---|---|
| 1) | Citric Acid | 12 |
| | Tartaric Acid | 23 |
| | Sodium Bicarbonate | 42 |
| | Sodium Carbonate | 21 |
| | Sodium Citrate | 2 |
| 2) | Citric Acid | 25 |
| | Ascorbic Acid | 22 |
| | Sodium Citrate | 22 |
| | Sodium Bicarbonate | 31 |
| 3) | Citric Acid | 16 |
| | Tartaric Acid | 31 |
| | Sodium Bicarbonate | 53 |
| 4) | Citric Acid | 15 |
| | Tartaric Acid | 31 |
| | Sodium Bicarbonate | 46 |
| | Sodium Carbonate | 7.5 |
| | Sodium Benzoate | 0.5 |
| 5) | Citric Acid | 15 |
| | Tartaric Acid | 30 |
| | Sodium Bicarbonate | 46 |
| | Sodium Carbonate | 7 |
| | Sodium Citrate | 1.5 |
| | Sodium Benzoate | 0.5 |

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

The invention has been described with reference to various specific and preferred embodiments and techniques. However, it should be understood that many variations and modifications may be made while remaining within the spirit and scope of the invention. It will be apparent to one of ordinary skill in the art that methods, devices, device elements, materials, procedures and techniques other than those specifically described herein can be applied to the practice of the invention as broadly disclosed herein without resort to undue experimentation. All art-known functional equivalents of methods, devices, device elements, materials, procedures and techniques described herein are intended to be encompassed by this invention. Whenever a range is disclosed, all subranges and individual values are intended to be encompassed. This invention is not to be limited by the embodiments disclosed, including any shown in the drawings or exemplified in the specification, which are given by way of example and not of limitation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

I claim:

1. A natural soap cleaning composition consisting of:

(a) at least one natural fatty acid saponified with a lye selected from the group consisting of sodium hydroxide, potassium hydroxide, and combinations thereof;

(b) a natural anti-redeposition agent selected from the group consisting of gluconic acid, sodium gluconate, and combinations thereof;

(c) at least one alkaline builder selected from the group consisting of sodium carbonate, sodium bi-carbonate, and combinations thereof; and (d) a pH adjusting agent;

wherein the natural soap cleaning composition contains no manmade detergent.

* * * * *